US009246252B2

(12) United States Patent
Kachlic et al.

(10) Patent No.: US 9,246,252 B2
(45) Date of Patent: Jan. 26, 2016

(54) ELECTRICAL CONNECTOR HAVING A THERMAL WASHER AROUND A PLURALITY OF CAGES ENCLOSING A PLURALITY OF HOUSINGS ON A CIRCUIT BOARD

(71) Applicant: Molex, LLC, Lisle, IL (US)

(72) Inventors: Jerry D. Kachlic, Glen Ellyn, IL (US); Philip J. Dambach, Naperville, IL (US); Emanuel G. Banakis, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/398,676

(22) PCT Filed: May 6, 2013

(86) PCT No.: PCT/US2013/039705

§ 371 (c)(1),
(2) Date: Nov. 3, 2014

(87) PCT Pub. No.: WO2013/166494

PCT Pub. Date: Nov. 7, 2013

(65) Prior Publication Data

US 2015/0087164 A1 Mar. 26, 2015

Related U.S. Application Data

(60) Provisional application No. 61/642,771, filed on May 4, 2012.

(51) Int. Cl.

| | |
|---|---|
| ***H01R 13/00*** | (2006.01) |
| ***H01R 13/648*** | (2006.01) |
| ***H01R 12/71*** | (2011.01) |
| ***H01R 13/6586*** | (2011.01) |
| ***H01R 13/659*** | (2011.01) |

(Continued)

(52) U.S. Cl.

CPC ..... *H01R 12/71* (2013.01); *H01R 13/648* (2013.01); *H01R 13/659* (2013.01); *H01R 13/6582* (2013.01); *H01R 13/6586* (2013.01); *H01R 24/00* (2013.01)

(58) Field of Classification Search

CPC ..... H01R 23/688; H01R 23/7073; H01R 13/65802; H01R 13/65807; H01R 13/65808

USPC ..... 439/485–487, 541.5, 607.05–607.08

See application file for complete search history.

(56) References Cited

U.S. PATENT DOCUMENTS

| | | | | |
|---|---|---|---|---|
| 6,824,429 | B2 | 11/2004 | Hwang | |
| 6,890,206 | B2 * | 5/2005 | Distad | G02B 6/4261 361/728 |
| 7,357,673 | B2 | 4/2008 | Long | |

(Continued)

OTHER PUBLICATIONS

International Search Report for PCT/US2013/039705.

*Primary Examiner* — Chandrika Prasad
(74) *Attorney, Agent, or Firm* — Stephen L. Sheldon

(57) ABSTRACT

A connector system includes a plurality of housing mounted on a circuit board and a plurality of cages are provided, each cage enclosing one of the housings, each of the cages including a front face that defines a first port, the cages being spaced apart a predetermined distance. A thermal washer is positioned around the cages, the thermal washer including a front portion and a main portion with air apertures that allow air to flow through the thermal washer and along a gap between the cages.

6 Claims, 6 Drawing Sheets

(51) Int. Cl.
*H01R 13/6582* (2011.01)
*H01R 24/00* (2011.01)

(56) References Cited

U.S. PATENT DOCUMENTS 7,845,975 B2 12/2010 Cheng et al.
8,830,679 B2 * 9/2014 Scholeno ..... H01R 13/6595 165/80.2
8,870,471 B2 * 10/2014 Ito ..... G02B 6/4277 385/88
8,929,078 B2 * 1/2015 Weeber ..... H01L 23/552 165/80.3
2009/0109627 A1 4/2009 Murr et al.
2012/0052718 A1 * 3/2012 Pocrass ..... H01R 24/64 439/485
2012/0058670 A1 3/2012 Regnier et al.
2013/0210269 A1 * 8/2013 Neer ..... G02B 6/4246 439/487

* cited by examiner

ELECTRICAL CONNECTOR HAVING A THERMAL WASHER AROUND A PLURALITY OF CAGES ENCLOSING A PLURALITY OF HOUSINGS ON A CIRCUIT BOARD

RELATED APPLICATIONS

This application claims priority to U.S. Provisional Application No. 61/642,771, filed May 4, 2012, which is incorporated herein by reference in its entirety.

FIELD OF THE INVENTION

The present invention relates to the field of input/output (IO) connectors, more specifically to IO connectors in a ganged configuration.

DESCRIPTION OF RELATED ART

The use of IO connectors is known. One typical application is a server or switch. In order to provide a sufficient number of IO ports, it is common to provide multiple IO connectors side by side in what is referred to as a ganged configuration. The use of ganged connectors decreases the space between connectors so that for a given width of switch it is possible to have additional ports. One issue that has arisen due to the increased number of ports is that it has become more difficult to cool the system. This cooling issue is further exacerbated by the fact that the modules being positioned in the ports are increasing requiring to be active (e.g., power consuming) components compared to the passive components that were frequently used in the past. Thus, existing ganged solutions that used a continuous cage system are becoming difficult to use due to thermal performance issues. Consequentially, certain individuals would appreciate further improvements to a ganged connector system.

BRIEF SUMMARY

A connector system includes a plurality of cages, each cage separately enclosing a housing, each cage defining at least one port. The cages are spaced apart so that there is a gap between adjacent cages. A thermal washer is provided around the plurality of cages. The thermal washer includes air apertures to allow air to flow between the gaps. The thermal washer can include a front portion that is configured to engage a front of the cage and can further include a sealing surface that allows the thermal washer to seal against a bezel.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
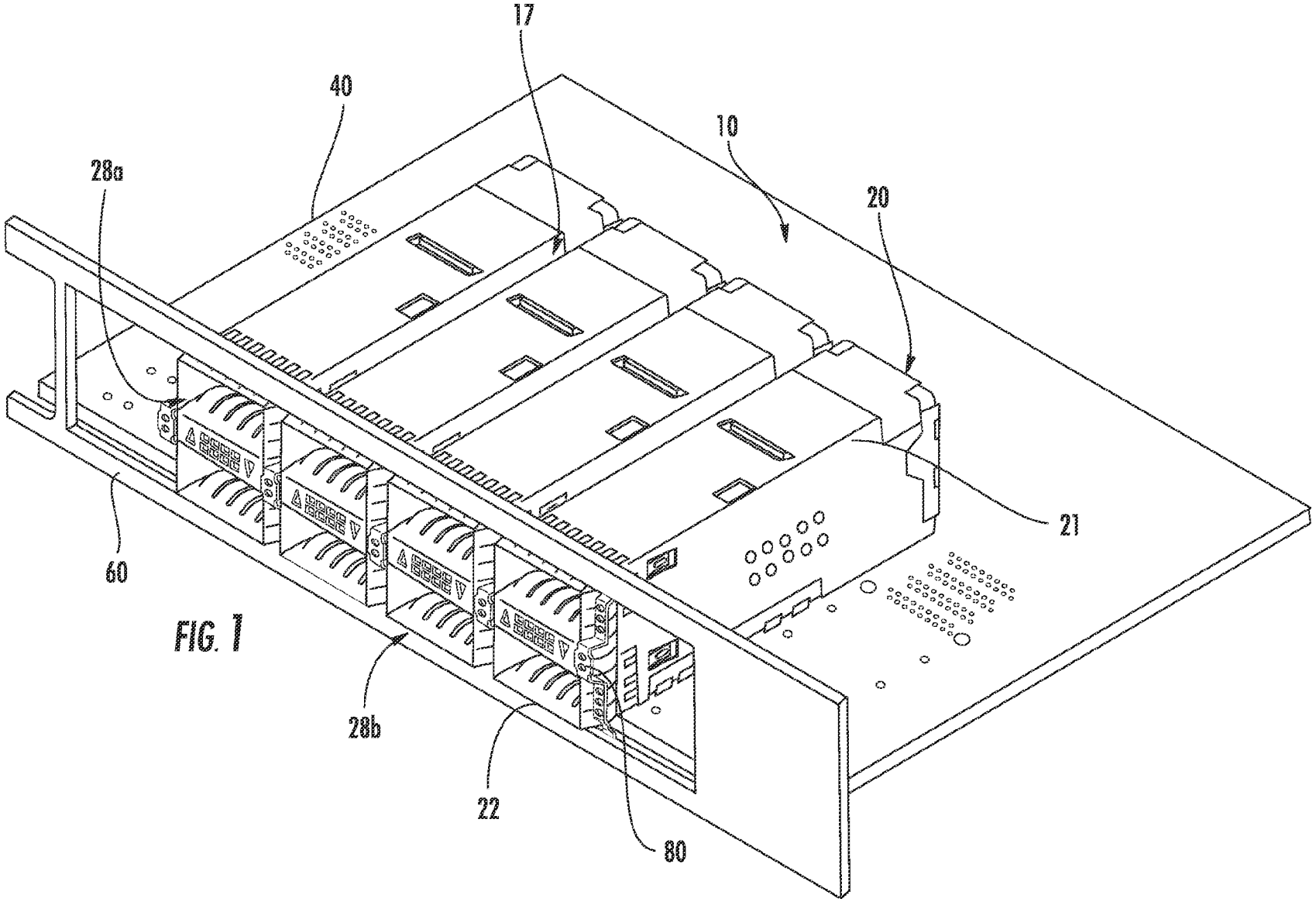
FIG. 1 illustrates a perspective simplified view of an embodiment of a ganged connector system.
Figure 2:
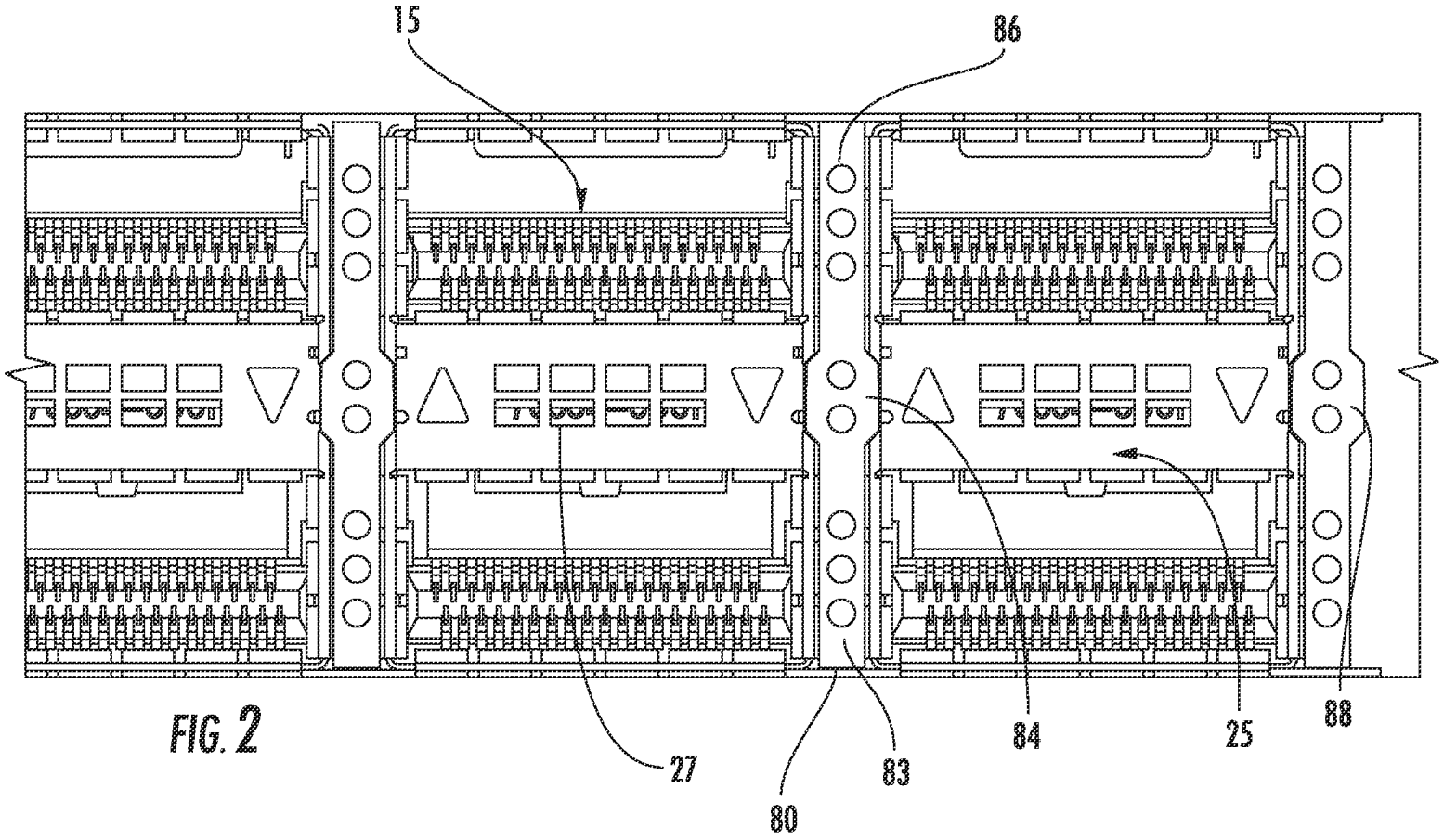
FIG. 2 illustrates an elevated front view of an embodiment of a ganged connector system.
Figure 3:
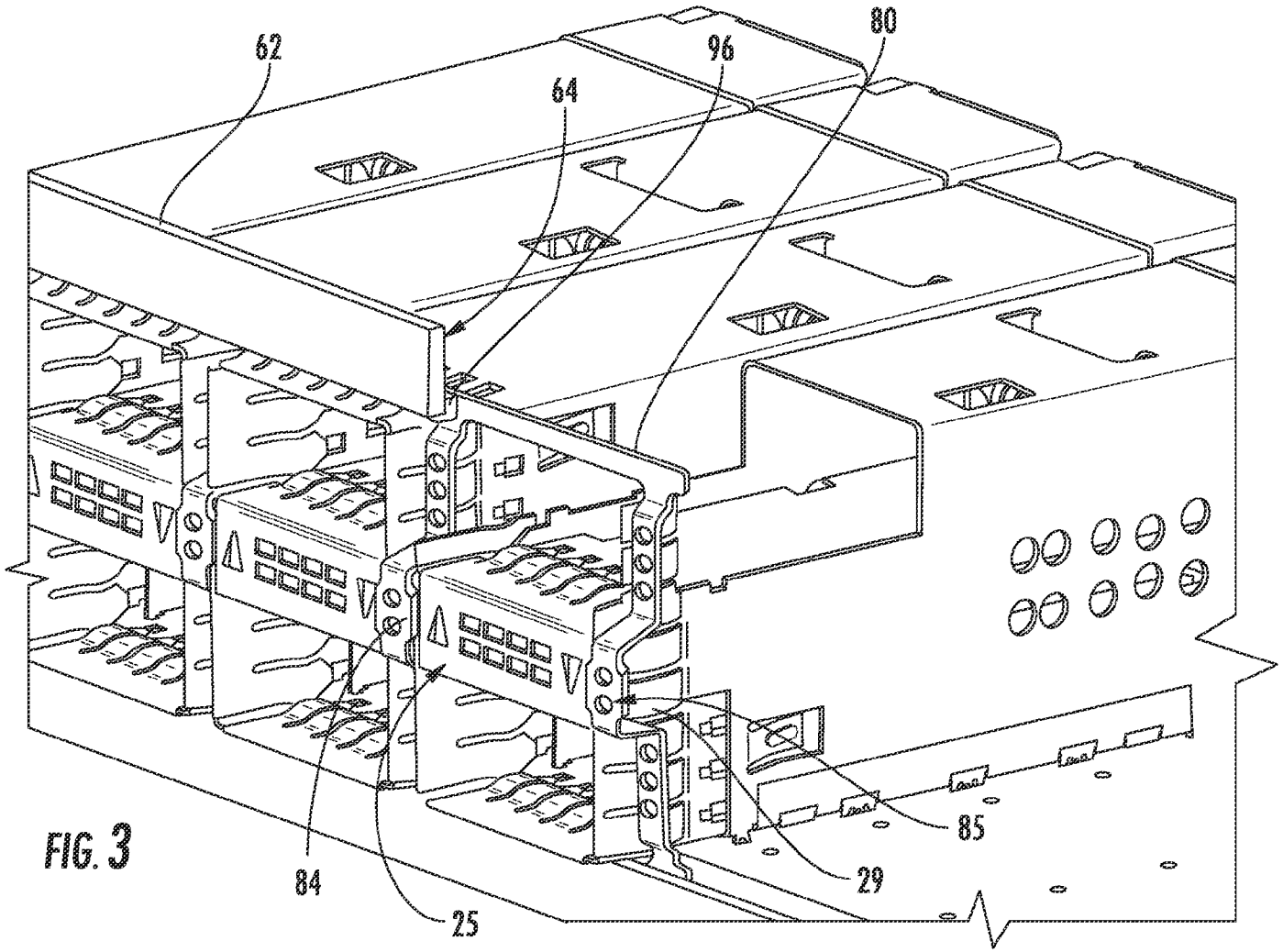
FIG. 3 illustrates a partial perspective view of an embodiment of a ganged connector system.
Figure 4:
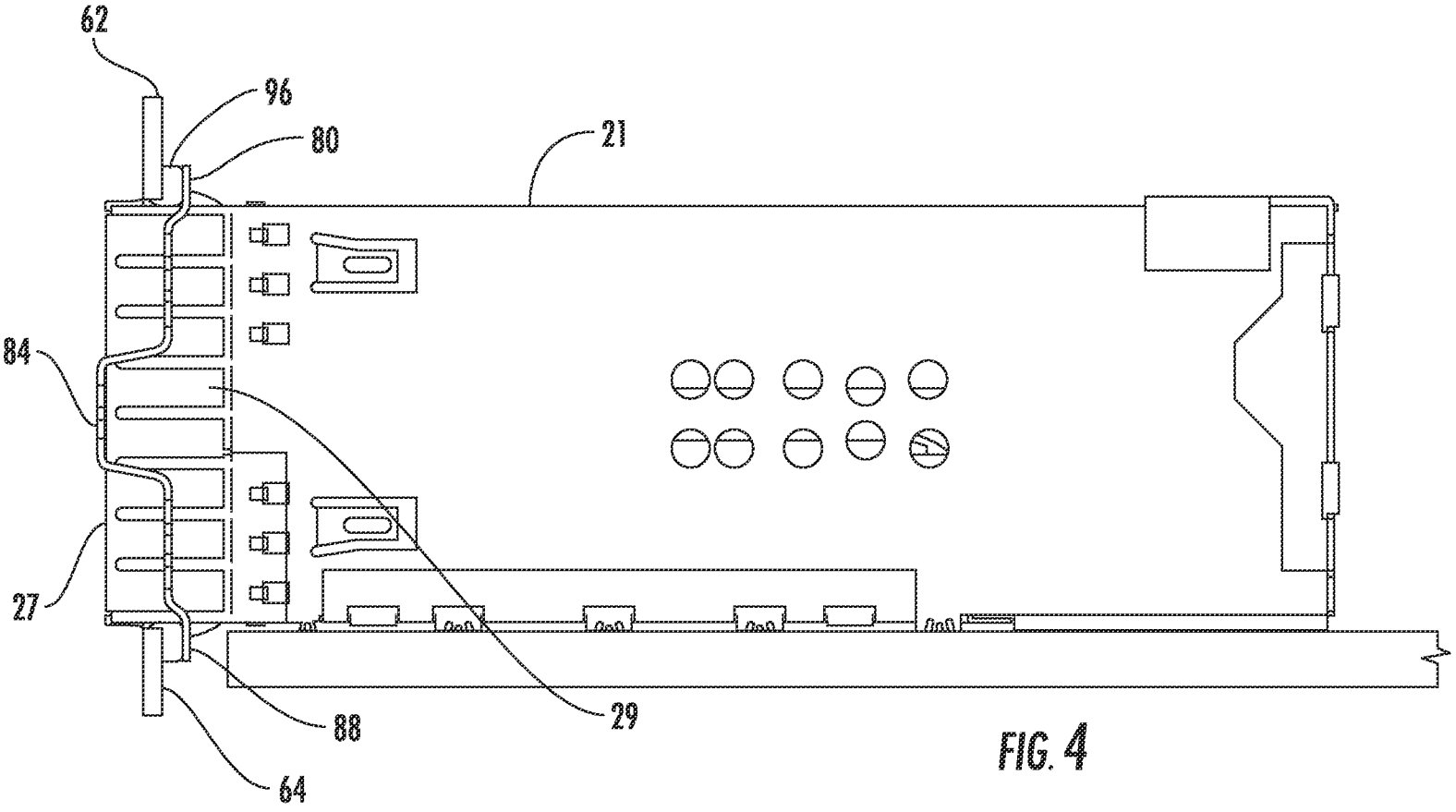
FIG. 4 illustrates an elevated side view of an embodiment of a ganged connector system.
Figure 5:
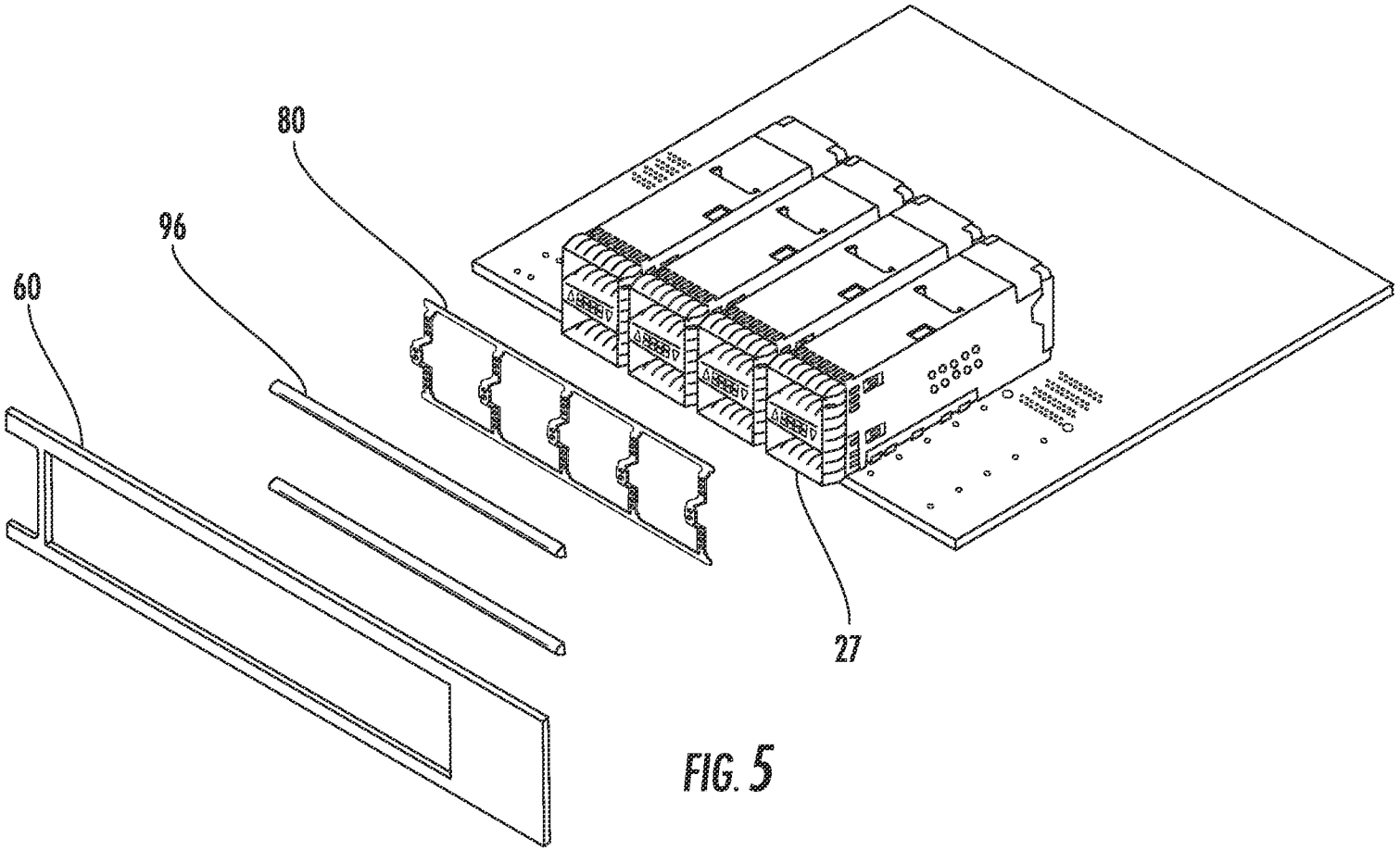
FIG. 5 illustrates a partially exploded perspective view of an embodiment of a ganged connector system.
Figure 6:
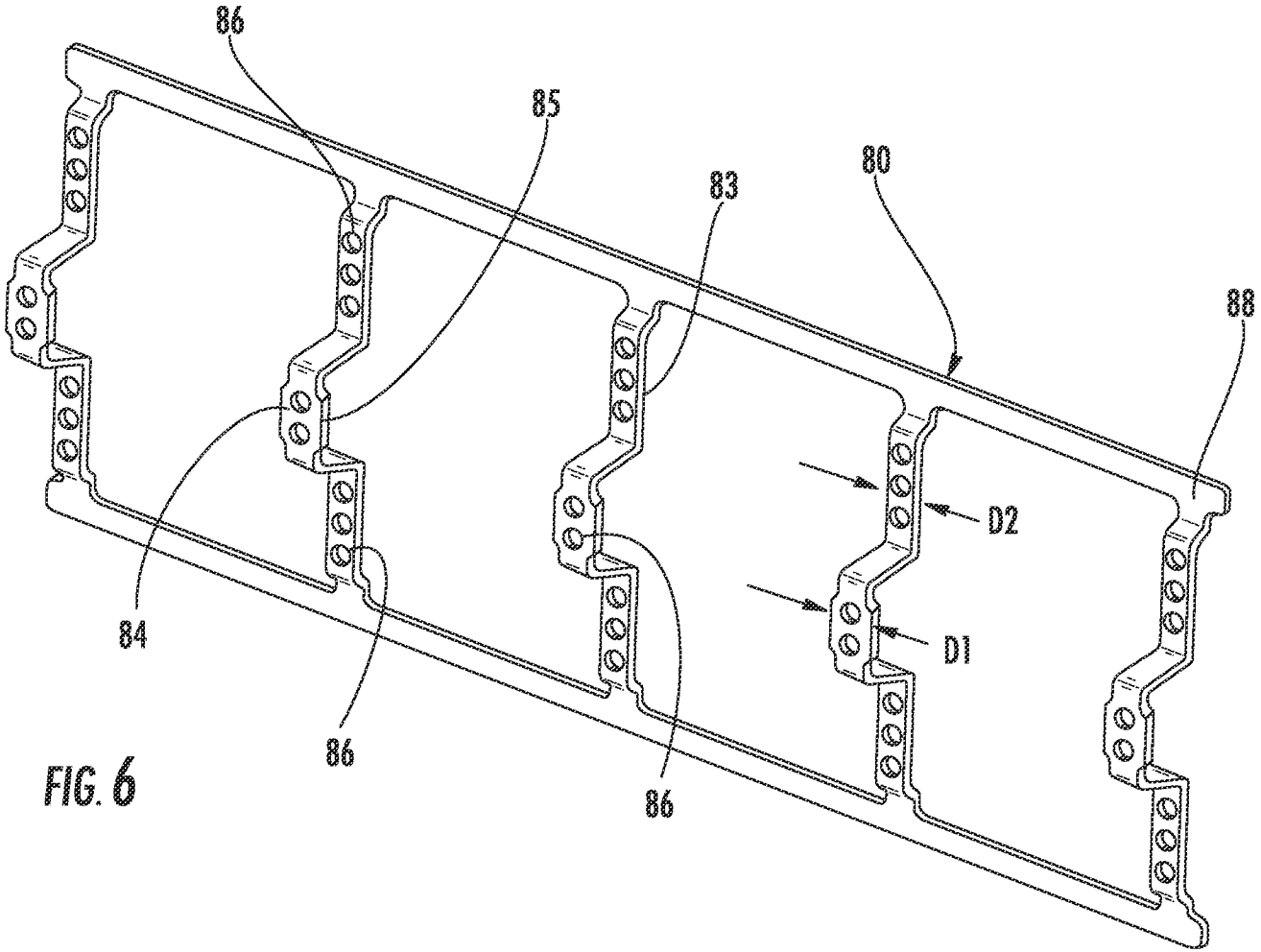
FIG. 6 illustrates a perspective view of an embodiment of a thermal washer.

FIGS. 1-6 illustrate features that may be incorporated into a ganged connector system 10. A circuit board 40 supports a plurality of housing 15 that are positioned side by side in spaced apart configuration with a plurality of cages 20 positioned around each housing 15 so that the housings are each separately enclosed. As can be appreciated, there is gap 17 between the adjacent exterior walls 21 of each adjacent cage 20, the gap 17 providing a predetermined distance between adjacent cages 20.

The cages 20 (and the corresponding housing 15) as depicted each provide a first port 28*a* and a second port 28*b*, the two ports being in a stacked configuration. It should be noted that if desired, however, the cage 20 and housing 15 could be configured so as to provide a single port. Such a configuration would be power profile but would also provide less ports per front edge of the circuit board 40.

A bezel 60 is depicted and the bezel 60 has an opening that extends around the plurality of cages 20. The bezel 60 includes a lip 62 that defines the opening and includes a rear surface 64 that can be supported by the structure that forms the switch or server in a conventional manner.

As can be appreciated, the depicted cages 20 have a front edge 22 and a front face 25 with apertures suitable for air and/or indicators (such as would be suitable for use with light pipes). A thermal washer 80 includes a front portion 84 that has edges 85 so as to provide the front portion with a first width D1. The front portion 84 is configured to press against the front face 25 and/or the front edge 22 of the cage. The thermal washer 80 further includes a main portion 83 with a width D2 and the main portion that is that is intended to be positioned between cages 20 and can engage an electromagnetic interference (EMI) gasket 29. The EMI gasket extends around a perimeter of the cage near the front face and allows the cage to have suitable EMI protection when the cage is inserted into the bezel. As depicted, the EMI gasket 29 includes fingers and the main portion 83 engages the fingers and causes them to deflect. As can be appreciated, the width D1 is great than the width D2, which allows the front of the cage 20 engage the thermal washer 80.

The thermal washer 80 includes a plurality of air apertures 86 that are configured to allow air to flow past the thermal washer and in the gap 17 between the cages 20. The air apertures 86 are provided on both the front portion 84 and the main portion 83. The thermal washer 80 also includes a sealing surface 88 that is configured to compress a seal 96 between the sealing surface 88 and the rear surface 64 of the bezel 60. The seal 96 can be configured to help block EMI so that the connector system can provide good EMI protection. Thus, the thermal washer 80 allows for thermally valuable air flow while providing suitable EMI protection. In addition, the design of the thermal washer allows the front of the cage 20 to press against the thermal washer 80 and that force causes the sealing surface 88 to compress the seal 96 against the rear surface 64 of the bezel 60.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector system, comprising:

a circuit board;

a plurality of housing mounted on the circuit board, the plurality of housings arranged side by side;

a plurality of cages, each one of the plurality of cages enclosing one of the plurality of housings, each of the cages including a front face that defines a first port and further including an electromagnetic interference (EMI) gasket that extends around a perimeter of cage near the front face, wherein the plurality of cages are spaced apart a predetermined distance;

a thermal washer positioned around the plurality of cages, the thermal washer including a front portion and a main portion, each of the front and main portions including air apertures, the main portion being a first width that is slightly less than the predetermined distance, the main portion engaging the EMI gasket, and the front portion having a second width that is slightly greater than the predetermined distance, the front portion engaging the front face so as to prevent, in operation, the front portion of the thermal washer from being pressed past the front face.

2. The connector system of claim 1, further comprising a bezel that extends around the front faces of the plurality of cages, the thermal washer having a sealing face that is configured to press against the bezel.

3. The connector system of claim 2, further comprising a seal that is positioned between the sealing face and the bezel, the seal being compressed between the sealing face and the bezel.

4. The connector system of claim 3, wherein the housings and the cages are configured to each provide two ports, one of the two ports stacked over the other of the two ports.

5. The connector system of claim 4, wherein the EMI gasket is a plurality of fingers and the main portion causes at least some of the fingers to deflect.

6. The connector system of claim 5, wherein the sealing surface is positioned rearward of the main portion so that the front portion is arranged on the front face, the main portion is recess rearward and the sealing surface is further recessed rearward compared to the main portion.

* * * * *